United States Patent [19]

Kordes et al.

[11] 4,351,579

[45] Sep. 28, 1982

[54] CLAMP FOR ELECTRICAL CABLE AND CABLE TERMINATING SYSTEM

[75] Inventors: Arthur W. Kordes, Los Altos; Robert M. Andrade, San Jose; Roger W. Peterson, Los Altos, all of Calif.

[73] Assignee: The Initiators, Los Altos, Calif.

[21] Appl. No.: 203,131

[22] Filed: Nov. 3, 1980

[51] Int. Cl.[3] ..... H01R 4/66; H01R 13/58

[52] U.S. Cl. ..... 339/14 R; 339/17 F; 339/103 M; 339/176 MF

[58] Field of Search ..... 339/17 F, 176 MF, 14 R, 339/14 L, 103 R, 103 M

[56] References Cited

U.S. PATENT DOCUMENTS

| | | | |
|---|---|---|---|
| 3,177,457 | 4/1965 | Croghan | 339/103 M X |
| 3,907,396 | 9/1975 | Huber | 339/17 F X |
| 4,130,334 | 12/1978 | Anderson | 339/103 M |

*Primary Examiner*—Eugene F. Desmond
*Attorney, Agent, or Firm*—Thomas Schneck

[57] ABSTRACT

A clamp for electrical cable, especially flat cable, wherein opposed jaws allow passage of the cable therethrough with fasteners providing inward biasing of the jaws toward mutual contact. Two recessed groove sections in each jaw provide a seat for the cable, including a more deeply recessed toothed section which grips the cable sheath, if any, and a less deeply recessed section which seats unsheathed cable. The jaws may be supported, vertically or horizontally, by stand-offs relative to a support structure. A conductive path is provided from the jaws, through the standoffs, to a support structure (electrical ground), for the purpose of grounding a wire mesh cable ground, frequently surrounding flat cable. The clamp is used proximate a cable connector so that the clamp and connector provide a complete mechanical and electrical cable termination system.

8 Claims, 5 Drawing Figures

CLAMP FOR ELECTRICAL CABLE AND CABLE TERMINATING SYSTEM

TECHNICAL FIELD

The invention relates to apparatus for terminating electrical cable, especially for use with an electrical connector.

BACKGROUND ART

Flat electrical cable, known as ribbon cable or electronic cable, sometimes known under the registered trademark "Scotchflex", consists of a plurality of parallel, mutually insulated wires, in flat cross sectional alignment. Introduced in the mid 1960's, this cable has become increasingly useful because of the increasing demand for interconnection of digital devices, such as computers, electronic keyboards, printers, disks and the like. Flat cable is neat, attractive and offers other advantages in interconnecting digital devices.

One of the problems which is encountered with flat cable is that mechanical strain is placed on connectors at the ends of the cable, just as strain is experienced by the plug at the end of an electrical cord. If someone trips over an electrical cord, strain is created at the plug, with the possibility of damage to the plug. In the case of flat cable, damage to one or both sides of a connector may be difficult to repair. There has been a need for an apparatus which would relieve mechanical strain from the cable, thereby protecting connectors.

Moreover, frequently flat cable is jacketed with copper mesh, resembling screen wire, with a rubber or vinyl sheath surrounding the copper mesh. There is a need to neatly terminate the wire mesh and insulative sheath in a manner such that these materials are held secure, without relying on the connector for this purpose.

DISCLOSURE OF INVENTION

An object of the invention was to devise a support or mechanical fastener to relieve strain in electrical cable, especially near connectors at the ends of the cable. Another object was to devise a means for terminating insulation or sheathing surrounding flat cable and providing a device for electrically grounding the copper mesh which often surrounds such a cable.

Yet another object of the invention was to devise a complete cable termination system which would cooperate with conventional cable connectors to provide total electrical and mechanical termination.

The above objects have been met with a clamp for electrical cable which includes jaws accommodating the cable therethrough and having means for securing the jaws relative to a support structure. The clamp may be used with known electrical connectors to provide complete mechanical and electrical cable termination. The jaws contact each other, encircling the cable, with the jaws defining a lengthwise tunnel for accommodating the cable through the center thereof. A first fastener means, such as a pair of opposed screws, urges the jaws together in the depthwise direction, constricting the tunnel to dimensions providing snug, non-crimping contact with the cable. A second fastener means, which may be a second pair of opposed screws, secures the jaws relative to a support structure so that tension on the cable is not transmitted along the cable through the clamp, but rather from the clamp to the support structure. A novel aspect of the invention is that it may be manufactured from identical halves which are connected together. Another novel aspect is that it may be mounted horizontally or vertically with respect to a support structure, depending upon the direction of cable travel. Still another novel feature is that the jaws, when made of metal, provide a conductive path for wire mesh surrounding the flat cable to be connected to electrical ground, associated with a clamp support structure.

The invention will be best understood with reference to the following drawings.

BEST MODE FOR CARRYING OUT THE INVENTION

Figure 1:
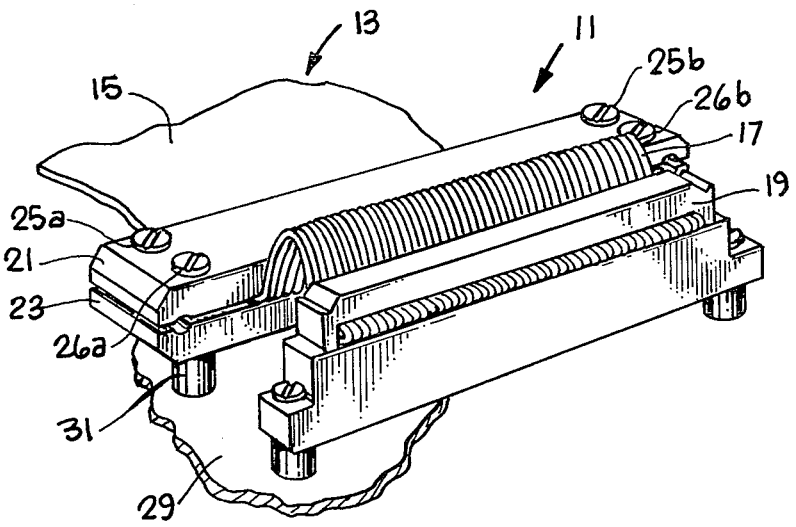
FIG. 1 is a perspective view of a flat electrical cable passing through the horizontally mounted cable clamp of the present invention and terminating at a connector.

With reference to FIG. 1, cable clamp 11 is shown mounted in a horizontal position. Flat electrical cable 13 is shown passing therethrough. The cable may have an insulative sheath 15. The sheath may be terminated within the clamp 11. Another portion 17 of the flat cable emerges from clamp 11 and is electrically terminated in standard connector 19. Connector 19 is illustrated to show the proximity of clamp 11 to a connector. The spacing between clamp 11 and connector 19 may be less than two centimeters.

Clamp 11 may be seen to comprise a first jaw 21 facing a second jaw 23. The two jaws are formed for mutual contact with the width of the jaws exceeding the width of the cable by about one centimeter or more on each side of the cable. The cable may have any number of conductors, typically from 10 to 64, with typical widths, including sheathing of between approximately 25 to 100 centimeters. The cable is accommodated within a lengthwise tunnel defined through the jaws. A first fastener means, namely the screws **25*a* and 25*b***, urge the jaws together in the depthwise direction, constricting the tunnel to dimensions so that the jaws maintain snug contact with the cable, but avoid crimping or bending wires within the cable. The constricting pressure of the jaws may cause indentations on insulation protecting the conductors, or on the wire mesh or sheath encircling the cable, but it is important that the fine conductors within the cable not be bent or otherwise deformed.

A second fastener means, comprising the screws **26*a* and 26*b*, while also urging the jaws 21 and 23 together, secures the jaws relative to a support structure 29, such as a conductive housing, being an electrical ground or communicating with such. Screw 26*a* projects through a tubular stand-off member 31 which may locate the clamp 11** at a desired elevation and position.

Approximately midway through the tunnel defined through the length of the jaws, there is a transition from sheathed cable to unsheathed. At this transition line, the sheathing is merely cut away and any wire mesh folded back to the line where the sheath cable enters the clamp. Unsheathed cable emerges from the opposite side of the clamp and terminates in connector 19.

Figure 2:
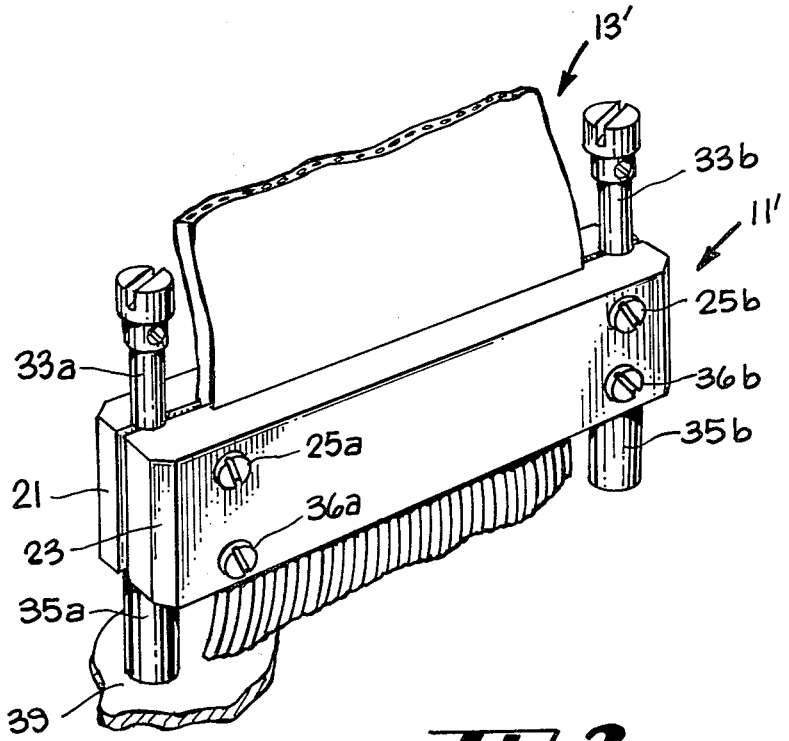
FIG. 2 is a vertically mounted clamp of the present invention, showing electrical cable passing therethrough.

With reference to FIG. 2, the cable 13' may be seen to be passing through clamp 11' which is now vertically aligned. The clamp is held in vertical alignment by a pair of long screws 33*a*, 33*b*. These screws pass through the width of clamping member 11' at locations spaced on opposite sides of flat cable 13'. The screws 33*a*, 33*b* pass through stand-offs 35*a*, 35*b* which are connected to a support structure. Preferably, the screws are conductive so that where the clamp 11' is conducted, the screws will form a conductive path to a support structure 39.

The construction of the clamping member 11' in FIG. 2 is identical to the construction shown in FIG. 1, except for the support screws 33*a*, 33*b*. The screws 25*a* and 25*b* urge the jaws 21 and 23 toward each other. Screws 36*a* and 36*b* are similar to screws 26*a* and 26*b* of FIG. 1, except that they are not as long, since they do not serve to pass through stand-offs.

Figure 3:
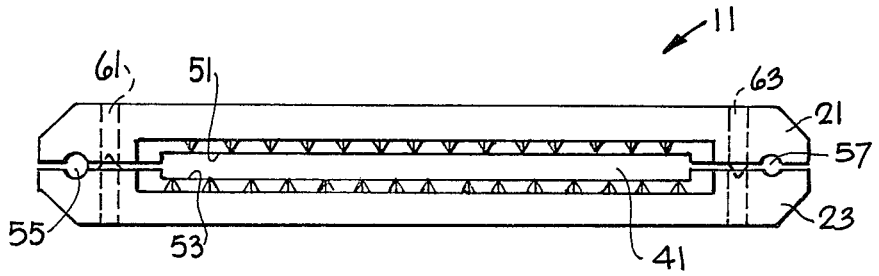
FIG. 3 is a side elevation of an empty clamp of the present invention for flat electrical cable.

FIG. 3 shows a front elevation of clamp 11 of FIG. 1, including an upper jaw 21 and a lower jaw 23. In this view, a tunnel 41 may be seen with the dimensions of the tunnel allowing flat penetration of the electrical cable through said jaws. The tunnel is formed by grooves 51, 53, defined in each jaw. The grooves are generally U shaped in cross section, with shallow sides and a broad base between the sides. The tunnel cross-sectional dimensions are slightly larger than those of the flat electrical cable to be terminated or supported. When the jaws are urged together, they contact the cable, but the dimensions of the grooves are such that the cable cannot be damaged by deformation. This is important because the wires used in flat cable are very thin and sometimes break under strain. When the jaws are in full contact, the cable is protected from damage from the jaws, as well as from accidental mechanical strain.

Each jaw is preferably made of metal in order to be conductive and serve as a grounding contact for the wire mesh which may surround the cable. The clamp may be seen to have lengthwise holes 55 and 57 for accommodation of the long screws 33*a* and 33*b* of FIG. 2, as well as vertically aligned holes 61 and 63 for accommodating the fastener means described with reference to FIG. 1.

Figure 4:
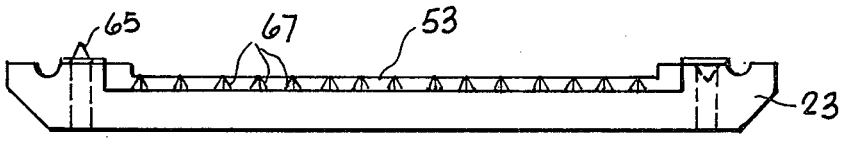
FIG. 4 is a side elevation of a single jaw of the clamp illustrated in FIG. 3.

With reference to FIG. 4, a single jaw 23 is shown with a groove 53. Each of the jaws carries an alignment lug, such as truncated conical lug 65 which fits into a corresponding hole in the opposite jaw. Groove 53 has two sections, including a section with teeth 67. These teeth extend toward the innermost portion of the tunnel defined by opposed jaws and serve to retain sheath insulation by biting into it, yet not crimping conductors within the cable. Generally the top of teeth 67 reach a height which is almost coplanar with another portion of the groove which does not have teeth. This portion may be more clearly seen with reference to FIG. 5.

Figure 5:
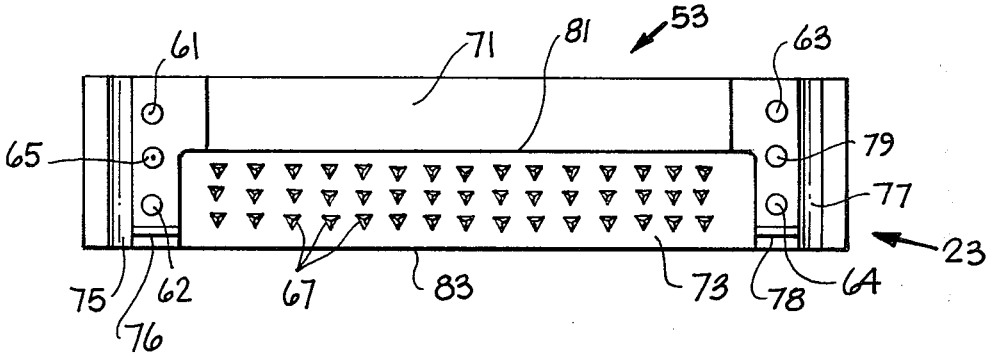
FIG. 5 is a top view of the jaw illustrated in FIG. 4.

In FIG. 5, the groove 53 may be seen to have a first recessed section 71 extending in the widthwise direction. The length of this section is approximately half the length of the jaw. The remaining recessed section 73 of the groove has teeth which are parallel in the upright direction, i.e., perpendicular to the plane of the drawing. The teeth are small pyramids or cones which extend uniformly inwardly, or upwardly in the drawing, toward the center of the tunnel formed by the jaws. The teeth of opposing jaws may either be oppositely aligned or not aligned. In either case opposed teeth will never contact each other, even with cable removed. The base of section 73 extends further laterally outwardly and in depth, forming a shoulder, relative to the flat recessed section 71 in order to accommodate the end of the sheath in the lower portion of the shoulder. As mentioned previously, the inwardmost extent of teeth 67 is generally coplanar with first recessed section 71. The upwardly extending lug 65 may be seen, as well as holes 61, 62, 63 and 64 which receive screws shown in FIGS. 1 and 2. Moreover, lengthwise channels 75 and 77 are shown which serve to form passages 55 and 57 in FIG. 3 for receiving long screws 33*a* and 33*b* of FIG. 2. An alignment hole 79 receives a lug corresponding to lug 65 from a facing jaw.

Each jaw has knurled or roughened conductive regions 76 and 78 provided for the purpose of making contact with one of the conductors of the flat cable. The conductive regions are connected to a further conductive path to electrical ground. In some applications, but not all, it is desirable to provide a ground for one of the conductive wires in the cable.

It should be noted that the two jaws of FIG. 3 are identical even though there is an alignment lug 65 on one side and a lug receiving hole 79 on the opposite side. When one jaw is placed atop the other jaw, so that the jaws are facing, an alignment lug 65 will fit into a lug receiving hole 79.

In operation, flat cable is laid within groove 53 and sheathing is trimmed at line 81 defining the boundary between section 71 and section 73 of groove 53. The portion of the cable with sheath remaining rests over teeth 67 with copper mesh, if any, folded back over the sheath and extending over the top of the sheathing as fas as the line 83 which marks the boundary of clamping member 23.

The apparatus of the present invention provides a system for terminating electrical cable in combination with a connector whereby mechanical strain is virtually eliminated from the nearby electrical connector. The cable clamp terminates electrical cable mechanically, and its sheath both mechanically and electrically, while the connector, such as a plug or socket, terminates the cable electrically.

We claim:

1. A clamp for sheathed or jacketed flat electrical cable comprising, first and second facing jaws formed for mutual contact, said jaws having a length, width and depth, with the width of said jaws exceeding the width of a flat electrical cable to be clamped, said jaws defining a lengthwise tunnel accommodating a flat electrical cable therethrough, fastener means for urging said jaws together in the depthwise direction, constricting said tunnel to dimensions providing snug non-crimping contact with the cable said jaws having a toothed section in said tunnel with teeth extending inwardly toward the central tunnel region from a first section recessed further outwardly relative to a second recessed section, said first section accommodating sheathed or jacketed cable, while said second section accommodates unsheathed or unjacketed portions of the same cable.

2. The clamp of claim 1 wherein the inwardmost extent of said teeth in said first section lies in a first plane and wherein said second section in said tunnel has a flat recessed wall section lying in a second plane, the second plane coplanar with the first plane.

3. The clamp of claim 2 wherein said jaws each have an identical shape, each jaw comprising a half of the clamp.

4. A clamp for sheathed or jacketed flat electrical cable comprising, first and second conductive jaws of equal width, said width exceeding the width of a flat electrical cable to be clamped, said jaws having mutually facing grooves, together forming a tunnel through said jaws, in a direction perpendicular to the width of said jaws, the dimensions of said tunnel allowing flat penetration of said cable through said jaws, fastener means for urging said jaws together constricting said tunnel to dimensions providing snug non-crimping contact with the cable said jaws having a flat recessed groove section extending in the widthwise direction and a parallel toothed groove section with teeth extending uniformly inwardly toward the central tunnel region from a section recessed further outwardly relative to said flat recessed section, said toothed section accommodating sheathed or jacketed cable, while said flat section accommodates unsheathed or unjacketed portions of the same cable.

5. An electrical cable terminating system comprising, an electrical cable having conductive wires therein, said wires surrounded by sheathing or jacketing and electrically terminating in an electrical connector, and a clamp disposed proximate to said electrical connector, said clamp having jaws with fastener means for urging said jaws together, the jaws accommodating said cable therethrough having means for securing said jaws relative to a support structure and having means for biting into the sheathing or jacketing of the cable inwardly of the jaws without crimping conductors in said cable, said biting means comprising a toothed section in said tunnel with teeth extending inwardly toward the central tunnel region from a first region recessed further outwardly than a second recessed region such that ends of the teeth are generally coplanar with the second recessed section.

6. The system of claim 5 wherein said jaws define a tunnel accommodating a flat cable therethrough and have first fastener means for urging said jaws together, constricting said tunnel to dimensions providing snug non-crimping contact with the cable and second fastener means for securing said jaws relative to said support structure.

7. The system of claim 5 wherein said clamp includes a conductive path to said support structure.

8. The apparatus of claims 1, 4 or 5 wherein a second fastener means is provided for securing said jaws to a support structure, said second fastener means comprising passages in each jaw which are mutually aligned on each side of the tunnel, a pair of tubular stand-off means for spacing the jaws relative to a support structure and screws passing through the passages, the stand-offs and into the support structure in a direction perpendicular to the direction in which said fasteners for urging said jaws together are operative.

* * * * *